US006440274B1

(12) United States Patent
Ikeda et al.

(10) Patent No.: US 6,440,274 B1
(45) Date of Patent: Aug. 27, 2002

(54) SHOE PRESS BELT AND MANUFACTURING METHOD

(75) Inventors: Harushige Ikeda; Kenji Inoue; Hironori Misawa, all of Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/692,275

(22) Filed: Oct. 19, 2000

(30) Foreign Application Priority Data

Oct. 22, 1999 (JP) ..... 11-301704

(51) Int. Cl.[7] ..... D21F 3/00; B29D 23/00

(52) U.S. Cl. ..... 162/358.4; 156/184; 156/195; 162/901

(58) Field of Search ..... 162/358.4, 901; 156/184, 185, 195; 198/847

(56) References Cited

U.S. PATENT DOCUMENTS 3,850,219 A * 11/1974 Snyder ..... 152/531
4,202,394 A * 5/1980 Vander Burg ..... 152/531
4,238,287 A * 12/1980 Gill ..... 162/361
5,365,988 A * 11/1994 Soderberg et al. ..... 162/527
5,396,755 A * 3/1995 Arnold ..... 156/184
5,792,323 A * 8/1998 Grondohl ..... 162/358.4
5,968,318 A * 10/1999 Hasegawa et al. ..... 162/901
6,086,719 A * 7/2000 Hasegawa et al. ..... 162/901

FOREIGN PATENT DOCUMENTS

CA 2068800 * 11/1992 ..... 162/901
JP 298292 12/1989

* cited by examiner

*Primary Examiner*—Karen M. Hastings
(74) *Attorney, Agent, or Firm*—Howson & Howson

(57) ABSTRACT

An easily manufactured shoe press belt for a papermaking machine comprises a high molecular weight cylindrical elastic member having embedded within it, between its inner and outer walls, a multiple layer base member formed by winding a belt-like woven fabric. The layers of the base member are substantially axially coextensive, reinforce the belt against sideward elongation, and achieve uniform hardness and improved durability.

12 Claims, 5 Drawing Sheets

SHOE PRESS BELT AND MANUFACTURING METHOD

SUMMARY OF THE INVENTION

This invention relates to papermaking, and more specifically to improvements in shoe press belts and in the methods of their manufacture in order to achieve uniform hardness and improved durability.

A shoe press is an apparatus used to squeeze water out of a web of pulp in the pressing stage of a papermaking machine. There are two types of shoe presses: open and closed. The open type shoe press takes up a large amount of space and has the drawback that it diffuses oil. Therefore, the current trend is toward the use of the closed shoe press.

In a closed-type shoe press, a shoe press belt passes between a press roll and a shoe. A pulp web containing water is sandwiched between upper and lower felts, which pass between the shoe press belt and the press roll. Water contained in the web is squeezed out, and transferred to the felts.

A conventional shoe press belt is typically composed of an endless layer of a high molecular weight elastic substance, and is reinforced by a base member, typically a woven fabric. The circumferential length of the belt is relatively short, and consequently its working conditions are severe. There has been a need for improvement in the durability of such belts.

Various proposals have been made for improving durability. According to one proposal, which will be discussed hereinafter in greater detail, a base member of a shoe press belt is formed by winding a narrow, belt-shaped member in a helix-like spiral in which successive layers overlap but are axially displaced from one another. The base member is covered by polyurethane, which is cured, cut to a desired thickness, and grooved.

The spirally wound base member is unable to impart adequate strength to the belt in the sideward (axial) direction, and consequently, the belt is likely to stretch sideward. In addition, the winding of the narrow belt-shaped member is time-consuming, and it is difficult to control the overlap of its successive layers. Hardness of the resulting belt may be affected, and its service life may be shortened as a result.

It is an object of this invention is to address the above-mentioned problems. More specifically, one object of this invention is to provide an improved shoe press belt having overall uniform hardness and improved durability. Another object of the invention is to simplify the manufacture of shoe press belts.

A preferred shoe press belt in accordance with the invention comprises a cylindrical, elastic member formed of a high molecular weight resin and having a base member embedded therein. The cylindrical member has inner and outer walls coaxially disposed about an axis and uniformly spaced from each other radially. Every point on the starting end of the belt is adjacent to a point on the terminal end. Thus, the cylindrical member has a uniform thickness. The base member embedded in the high molecular weight resin is located between the inner and outer walls of the cylindrical member and comprises a belt-shaped member spirally wound in multiple layers which are substantially coextensive axially. The belt-shaped member by itself has the ability to resist both lateral and longitudinal stretching. By virtue of the above structure, the shoe press belt will exhibit uniform hardness over substantially its full width.

Preferably, the belt-shaped member comprises a woven fabric impregnated with the same resin as the resin of which the cylindrical, elastic member is formed. The use of the same resin for both purposes produces a strong bond not only between the layers of the belt-shaped member, but also between the wound belt-shaped member and the cylindrical, elastic member.

The shoe press belt is preferably made by the steps of winding a belt-shaped member, in multiple, substantially axially coextensive layers, onto a support body having a cylindrical surface, and forming, from a resin, a cylindrical, high molecular weight elastic member on the base member so that the base member is embedded within the wall thickness of the elastic member. A belt having uniform hardness uniform hardness over its width is thus manufactured relatively easily.

Preferably the belt-shaped member is wound from a woven fabric already impregnated with the same resin from which the elastic member is to be formed. Thus good inter-layer integration in the base member, and good integration between the base member and the elastic member, are achieved easily.

Other objects, details and advantages of the invention will be apparent from the following detailed description when read in conjunction with the drawings.

DETAIL DESCRIPTION

First, referring to FIGS. 9 and 10(*a*)–10(*c*), the structure and operation of a closed-type shoe press and the structure and formation of a typical prior art shoe press belt will be discussed.

Figure 9:
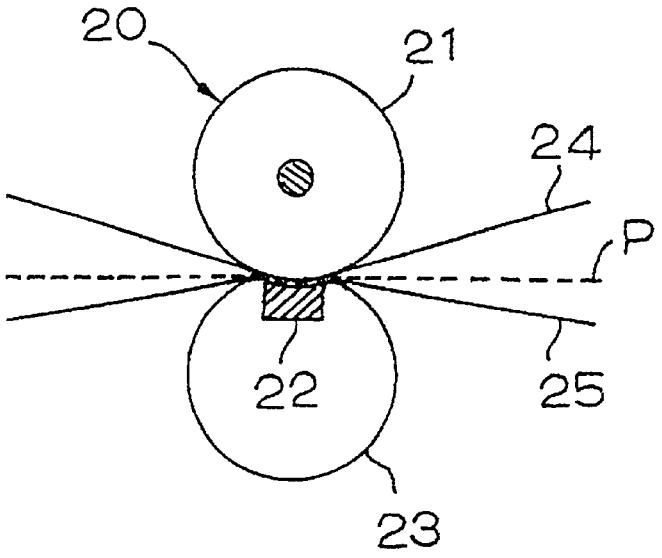
FIG. 9 is a schematic view of a conventional shoe press.
Figure 10A:
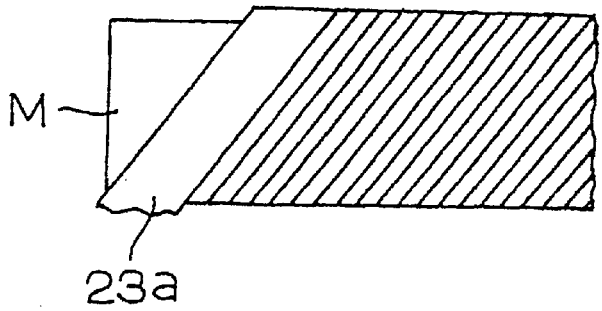
FIG. 10A PRIOR ART
FIGS. 10(*a*)–10(*c*) are schematic views showing the manufacture of a typical conventional shoe press belt.
Figure 10B:
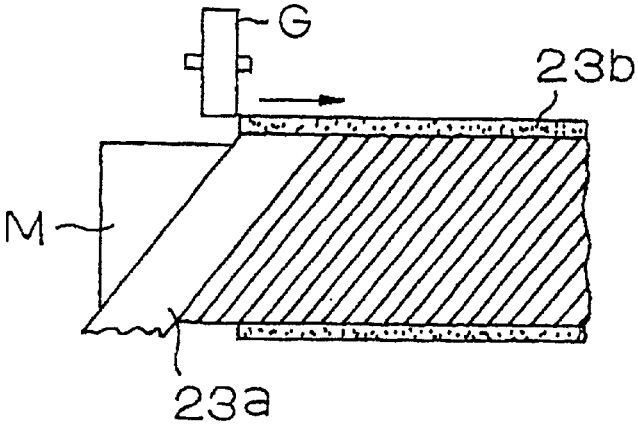
FIG. 10B PRIOR ART
Figure 10C:
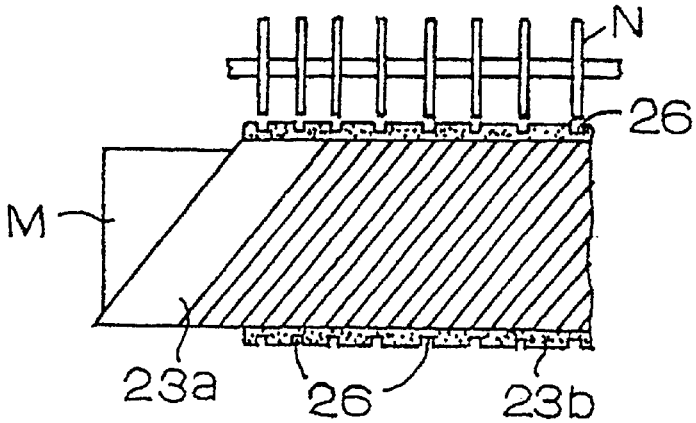
FIG. 10C PRIOR ART

As shown in FIG. 9, the closed-type shoe press 20 comprises a press roll 21 and a shoe 22. A belt 23 passes between the press roll and the shoe. A web P, containing water, is sandwiched between an upper needle felt 24 and a lower needle felt 25, which are arranged to pass between the shoe press belt 23 and the press roll 21. Water contained in the web P is pressurized in the nip formed by the press roll and the shoe, squeezed out of the web, and transferred to the upper and lower felts.

The shoe press belt 23 is composed of an endless layer of a high molecular weight elastic substance, and is reinforced by a base member, typically a woven fabric. An oil supply (not shown) is provided to supply oil to reduce friction between the shoe press belt 23 and the shoe 22. However, since the circumferential length of the belt is relatively short, the working conditions are very severe, and, as mentioned above, there has been a need for improvements in durability of such belts.

One of the proposals for improving shoe press belt durability is represented by the technology disclosed in unexamined Japanese patent publication No. 298292/1989. According to this technology, illustrated in FIG. 10(*a*), a base member is first made by winding a narrow, belt-shaped member 23*a* about a cylindrical, rotating mandrel M in a helix-like spiral in which the successive layers overlap but are axially displaced from one another. The belt-shaped member consists of a fiber mat impregnated with polyurethane. As shown in FIG. 10(*b*), polyurethane 23*b* spread onto the base member by a nozzle (not shown). The diameter of mandrel M corresponds to the diameter of the shoe press belt to be obtained. A heater (not shown) is used to cause the polyurethane 23*b* to gel. The polyurethane is then cured in an oven and the belt is then subjected to cooling in a cooler after curing.

The outer surface of the layer of cured polyurethane 23*b*, which has been formed on the spirally wound belt-shaped member 23*a*, is next cut to a predetermined thickness by a cutting roll G. Then, as shown in FIG. 10(*c*), water-draining grooves are formed in the surface of the polyurethane layer by a cutter N, completing the formation of the belt.

The spirally wound base member is unable to impart adequate strength to the belt in the sideward (axial) direction, and consequently, the belt is likely to stretch sideward. Moreover, the manufacturing process is time-consuming since it is necessary to wind the narrow, belt-shaped member 23*a* onto the mandrel M. In addition, it is difficult to adjust the overlap of the successive layers of the spirally wound belt-shaped member. The degree of overlap must be carefully controlled because, if the degree overlap is not appropriate, the hardness of the belt will be affected or may vary along the width of the belt. In such cases, cracks may occur in the belt, shortening its service life.

Embodiments of the invention will be now be described referring to FIGS. 1 to 8. The terms "cylinder" and "cylindrical" are used herein in the broad sense, to refer to non-circular as well as circular cylinders and cylindrical shapes. It should be understood that the shape of a shoe press belt may depart from a true cylindrical shape during installation. However, in use, the belt will generally be substantially cylindrical.

The belt 1 in accordance with the invention comprises a cylindrical, high molecular weight elastic member 2 and a base member 3 disposed between the inner and outer walls, i.e. in the wall thickness, of the high molecular weight elastic member 2.

The base member 3 comprises a belt-shaped member 4 cylindrically rolled in plural layers, so that the layers of the belt-shaped member are substantially axially coextensive. That is, the side edges of the belt-shaped member are disposed substantially in planar spirals, so that the layers are not axially displaced from one another. For the belt-shaped member 4, it is preferable to use a woven fabric consisting of warp and weft, impregnated with the same resin that constitutes the high molecular weight elastic member 2.

To ensure that the shoe press belt has an overall uniform thickness when the base member 3 comprises a belt-shaped member 4 wound to form plural layers, it is necessary to consider the positions of the starting end 4*a* and the terminal end 4*b*. The starting end 4*a* and the terminal end 4*b* of the belt-shaped member should both lie approximately an imaginary radial plane (represented by arrow S in FIG. 1) in which the central axis O of the cylindrical belt 1 lies. It has been confirmed experimentally that no problem arises if the ends 4*a* and 4*b* are located within a narrow space A, about 100 mm in width, centered on the above-mentioned plane S. In case of FIG. 2, the starting end 4*a* and the terminal end 4*b* coincide with the same imaginary radial plane.

It is preferable that the belt-shaped member 4 be impregnated with a the same resin as that to be used in forming the high molecular weight elastic member 2, and that the impregnated resin be semi-cured before the belt-shaped member is rolled. Use of the resin strengthens the inter-layer bonding of the plural layers of the base member. Further, the use of the same resin improves the integration of the base member 3 with the high molecular weight elastic member 2. It has been confirmed experimentally that 1.5–5 mm is preferable as the thickness of the base member 3. It follows that the thickness of the woven fabric 4 itself should be 1.5 mm or less.

For the above-mentioned high molecular weight elastic member 2, polyurethane elastomer, etc. of hardness 80–98° (JIS-A) is a suitable resin. It is possible to use different resins for the inner, shoe-contacting portion 2*b* and for the outer, felt-contacting portion 2*a*. However, it is also possible to form all portions of the elastic member from the same materials. In the latter case, the integration of the joining surfaces may be improved while minimizing manufacturing costs.

It is preferable that the thickness F1 between the outer surface of portion 2*a* of the elastic member 2 and the base member 3 be 1 mm or more. Water draining grooves (not shown) may be provided if necessary so that the outer portion 2*a* can serve to carry a wet web. Moreover, for satisfactory durability, it is necessary that the thickness F2 between the base member 3 and shoe-contacting surface of inner portion 2*b* of the elastic member 2 be 0.5 mm or more.

Figure 1:
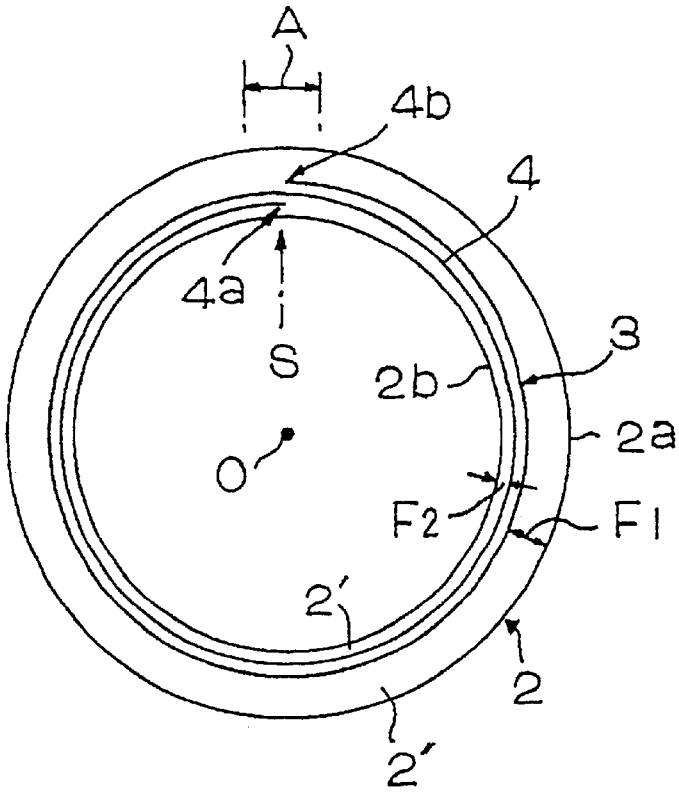
FIG. 1 is a schematic sectional view of a belt in accordance with the invention.
Figure 2:
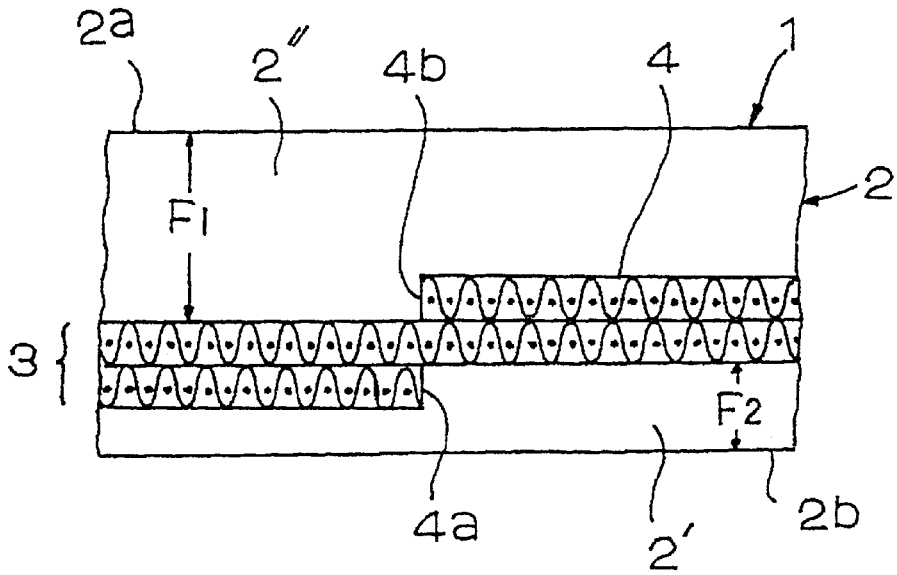
FIG. 2 is a partial enlarged sectional view showing the positional relationship of the starting and terminal ends of a woven fabric belt-shaped base member within a high molecular weight elastic member.
Figure 3:
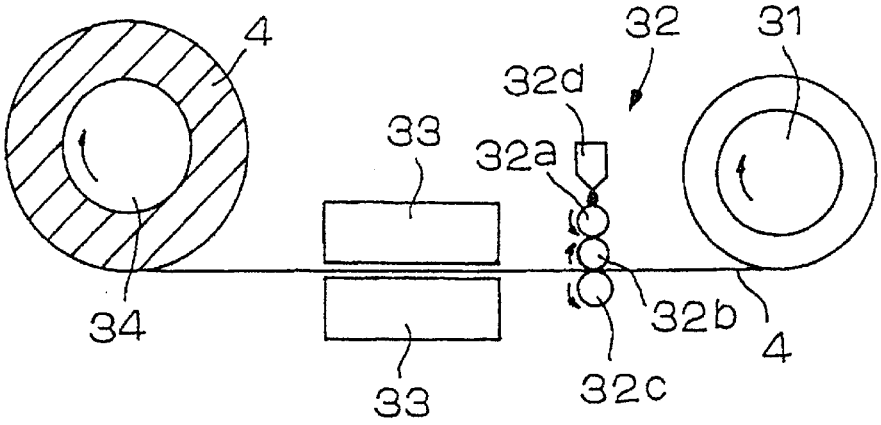
FIG. 3 is a schematic view of an apparatus for applying a resin to a woven fabric belt-shaped base member.

In the manufacture of the shoe press belt, first, a base member 3 is prepared. The base member is made from a belt-shaped member 4 (preferably a woven fabric and hereafter simply called the "woven fabric"). The base member 3 is prepared by unwinding the woven fabric from a supply roll 31 as shown in FIG. 3. One end of the woven fabric is drawn out from the supply roll, and secured to a roll 34. Between rolls 31 and 34, the woven fabric passes through a resin applicator 32 and a heater 33. This woven fabric is slightly wider than the full width of the belt 1 to be obtained.

The resin applicator 32 is composed of a set of three rolls 32*a*, 32*b* and 32*c*, and a resin tank 32*d*. The resin material dropped from the tank 32*d* to the uppermost roll 32*a*is applied both to the outside and to the inside of the woven fabric which passes between the middle roll 32*b* and the bottom roll 32*c*. The woven fabric, thus impregnated with the resin, passes through the heater 33, and is wound onto the roll 34 in a semi-cured state.

Figure 5:
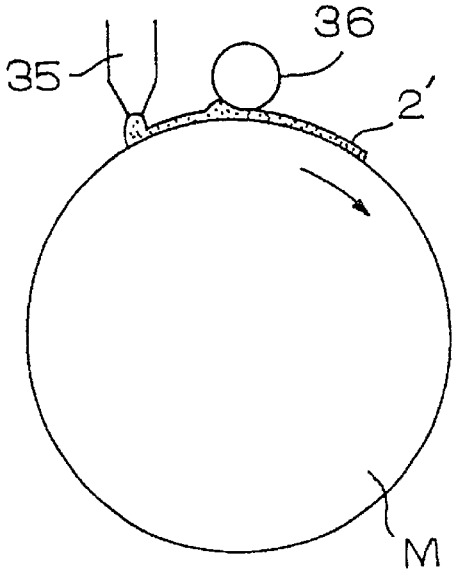
FIG. 5 is a schematic view showing the formation of the inner, shoe-contacting portion of the resin layer.

A releasing agent is then applied on the surface of a mandrel M, shown in FIG. 5. A resin layer 2', constituting the inner portion 2*b* of the shoe press belt, which becomes the shoe contacting side of the belt, is formed with a uniform thickness while rotating the mandrel M, utilizing a resin applicator 35 and a coater bar 36 above the mandrel M.

Figure 4:
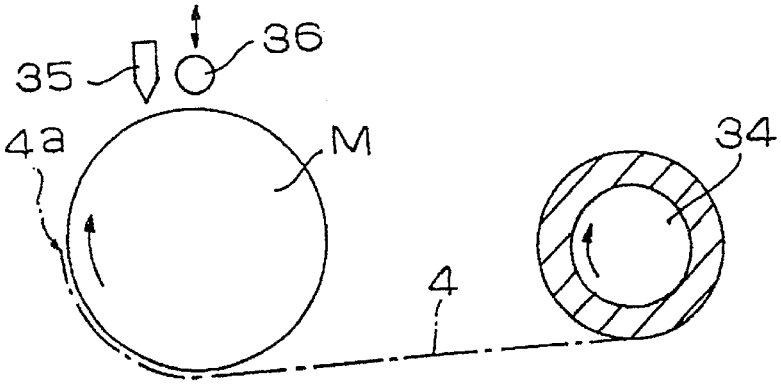
FIG. 4 is a schematic view showing the stage of the manufacturing process prior to the formation of an inner, shoe-contacting, resin layer.

The roll 34 is positioned next to a mandrel M, as shown in FIG. 4, and one end of the woven fabric (the starting end 4*a*) is drawn out from roll 34 and secured to a predetermined position on mandrel M as shown by the dot dash line. The starting end 4*a* of the woven fabric drawn out from the roll 34 is secured to the mandrel M after the resin layer 2' has cured.

Figure 6:
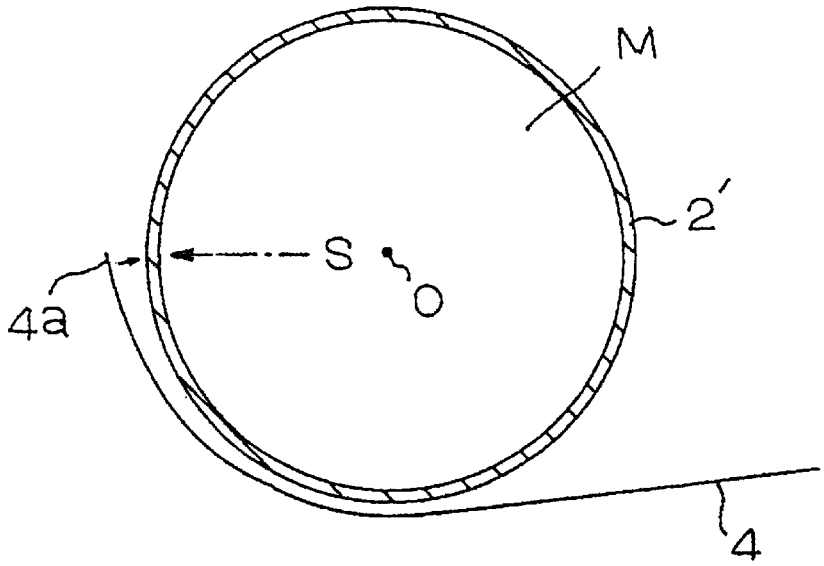
FIG. 6 is schematic view showing the attachment of the starting end of the belt-shaped base member.

As shown in FIG. 6, at the position indicated by arrow S a base line is drawn on the surface of the mandrel M parallel to the central axis O of the mandrel, and the starting end 4*a* of the woven fabric is positioned to register with this base line. Since a semi-cured resin is impregnated and in the woven fabric, the resin functions as a bonding agent when the starting end 4*a* of the woven fabric is secured to the resin layer 2'.

Figure 7:
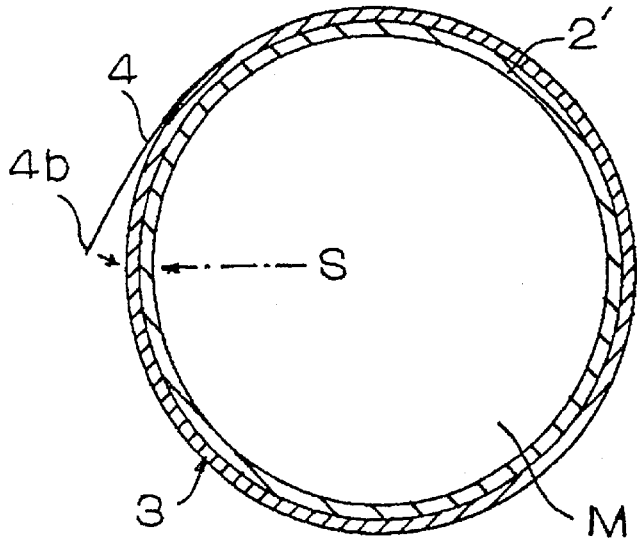
FIG. 7 is a schematic view showing the attachment of the terminal end of the belt-shaped base member.

Next, as shown in FIG. 7, a predetermined number of turns of woven fabric 4 are rolled onto the mandrel M as the mandrel is rotated, forming layers of woven fabric. The terminal end 4*b* is cut at a position which corresponds to the position of the starting end 4*a*. Since the resin impregnated into the woven fabric is semi-cured, excellent bonding between the layers of the woven fabric is achieved.

Figure 8:
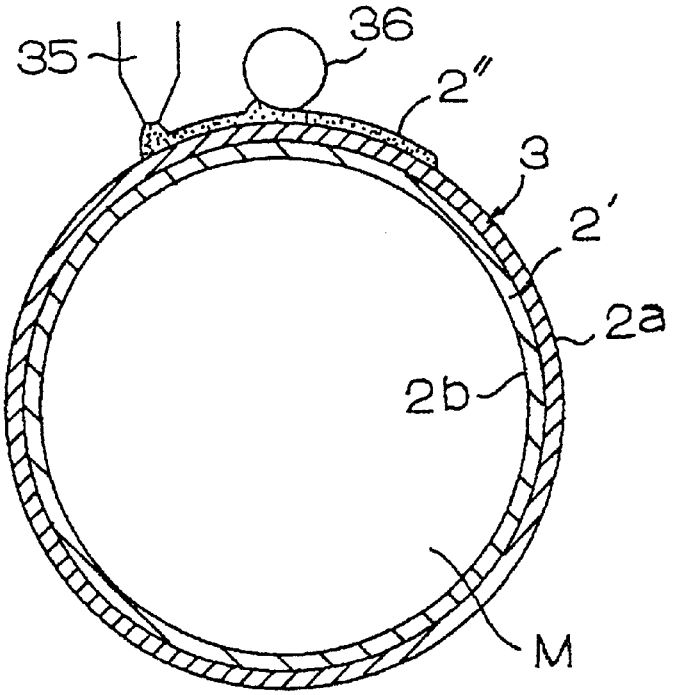
FIG. 8 is a schematic view showing the formation of the outer, felt-contacting portion of the resin layer.

After the base member 3 is formed, the outer resin layer 2", constituting the outer portion 2*a* of the shoe press belt, is formed by spreading the resin of the high molecular weight elastic member 2 onto the outer surface of the base member 3, using an applicator 35 and a coater bar 36, as shown in FIG. 8. The resin is impregnated into the base member. This process is also carried out while the mandrel M rotates.

Thereafter, the resin layer 2" of the outer portion 2*a* is left at room temperature or semi-cured by means of a heater (not shown); and fully cured thereafter, throughout the shoe press belt structure, by means of a heater (not shown). After curing, the resin layer 2" is ground to obtain a belt of a desired thickness. In addition, if necessary, water draining grooves are formed, and the belt 1 is completed. Then, the belt may be detached from the mandrel M, and ear portions (not shown), for facilitating installation on a papermaking machine, are formed at both ends of the belt.

In the above-described example, the base member 3 is made from a belt-shaped member 4 in the form of a woven fabric impregnated with a semi-cured resin material. But, the invention is not limited to such an example, and it is possible to adopt a manufacturing method in which no resin material is initially impregnated into the woven fabric as in FIG. 3. In this alternative process, as shown in FIG. 5, a resin is spread on the mandrel M. Then, a woven fabric 4 is rolled onto the spread resin in the manner described with reference to FIGS. 6 and 7 to form a base member 3 with layers. Thereafter, the resin is further spread on the base member 3 as shown in FIG. 8. In this case especially, it is important to make sure that the resin spread onto the base member 3 fully penetrates into the lowermost layer of the woven fabric 4.

According to the above-described alternative method of manufacture, shortening of manufacturing time as well as reduction in the costs of equipment can be achieved, because the process of impregnating the woven fabric with the resin material and semi-curing it is not required. But, if a woven fabric with impregnated and semi-cured resin is employed, it is possible to obtain a highly durable shoe press belt easily, inasmuch as the resin material positively penetrates into voids of the fibrous structure of the woven fabric 4, and into the gaps between the layers of the woven fabric.

A fabric 0.4 mm in thickness, woven in a ⅓ broken plain weave, was prepared with a warp of 1500d/150f multifilament and a weft of 1000d monofilament.

Thermosetting polyurethane resin was thinly applied to both sides of the woven fabric, and semi-cured by application of heat at 100° C. for 30 minutes by a heater. The measured thickness of the woven fabric was 0.5 mm.

To form a base member, three turns of woven fabric, with resin applied to it, were wound onto a 0.5 mm thickness thermosetting polyurethane resin layer spread on a mandrel 1.5 m in diameter, coated with a silicone releasing agent. The 0.5 mm resin layer formed the inner, or shoe-contacting, side of the shoe press belt. The starting end and the terminal end of the woven fabric were opposed to each other with a gap of 50 mm. Thermosetting polyurethane resin was further impregnated into the fabric texture, and a 2.5 mm thick thermosetting resin layer, constituting the outer portion of the shoe press belt, was formed on the base member. Thereafter, the thermosetting resin layer was irradiated with far-infrared radiation to semi-cure it, and a hot air stream, at a temperature of 100° C., was added in order to cure the resin fully.

After the curing process, at the time when the resin hardness reached 90° or more, the surface of the thermosetting polyurethane resin layer which forms the outer portion was ground using an abrasive cloth. Then, grooves of 0.8 mm in depth, and 0.8 mm in width with a pitch of 10 ridges/inch were cut circumferentially by a cutter and the belt was completed. The total thickness of the belt was 4.5 mm, as it was ground by 0.5 mm in the grinding process.

In addition to the cylindrical belt completed as above-mentioned, a comparative belt of the same diameter was made w based on the teaching of the cited Japanese Unexamined Patent Publication No. 298292/1989. The two belts were tested by running them through testing equipment similar to the shoe press apparatus of FIG. 9. The number of revolutions until a crack occurred in each belt was counted by a monitoring mirror. At 1,000,000 revolutions, a crack was observed in the comparative belt, but no cracks were seen in the belt made in accordance with the invention. Thus, the belt of the invention was found to have excellent durability.

As described above, the shoe press belt of the invention comprises a cylindrical, elastic member formed of a high molecular weight resin and having a base member embedded therein, the cylindrical member having inner and outer walls coaxially disposed about an axis, the inner and outer walls being uniformly spaced from each other radially, whereby the cylindrical member has a uniform thickness, and the base member embedded in the high molecular weight resin being located between the inner and outer walls of the cylindrical member and comprising a belt-shaped member spirally wound in multiple layers, the multiple layers being axially substantially coextensive. The belt-shaped member wound in this manner is capable of strengthening the belt in the sideward direction and eliminating concerns about sideward elongation. In addition, the hardness of the belt can easily be made uniform over the its full width without the need for adjustments to control the degree of overlap of the layers making up the base. As a result, cracks in the belt are much less likely to occur as a result of the stresses imparted to the belt in the operation of the papermaking machine, and a longer belt life is obtained.

When the belt-shaped member comprises a woven fabric impregnated with the same resin as the resin of which the cylindrical, elastic member is formed, a strong bond is achieved between the layers of the woven fabric themselves, and between the wound woven fabric and the high molecular weight elastic member.

The method in accordance with the invention comprises the steps of winding a belt-shaped member onto a support body having a cylindrical surface in multiple, substantially axially coextensive layers, and forming, from a resin, a cylindrical, high molecular weight elastic member on the base member so that the elastic member has a wall thickness and so that the base member is embedded within the wall thickness of the elastic member. It is only necessary to wind a few turns of the belt-shaped member onto a mandrel, and production time is significantly shortened. Moreover, more uniform hardness is achieved over the full width of the belt, and high durability is achieved easily.

When the belt-shaped member is wound from a woven fabric impregnated with the same resin from which the elastic member is formed it is easy to achieve a strong bond between the layers of the belt-shaped member and between the belt-shaped member and the high molecular weight elastic member.

We claim:

1. A shoe press belt comprising a cylindrical, elastic member formed of a high molecular weight resin and having a base member embedded therein, the cylindrical member having inner and outer walls coaxially disposed about an axis, the inner and outer walls being uniformly spaced from each other radially, whereby the cylindrical member has a uniform thickness, and the base member embedded in the high molecular weight resin being located between the inner and outer walls of the cylindrical member and comprising a belt-shaped member having a starting end, a terminal end and parallel side edges, every point on said starting end being adjacent to a point on said terminal end, the belt-shaped member by itself having the ability to resist both lateral and longitudinal stretching, and being spirally wound in multiple layers, with its side edges disposed substantially in planar spirals, whereby the belt-shaped member of the base has substantially the same width as the belt.

2. A shoe press belt according to claim 1, wherein the belt-shaped member comprises a woven fabric impregnated with the same resin as said resin of which the cylindrical, elastic member is formed.

3. A shoe press belt according to claim 1, wherein the belt-shaped member comprises a woven fabric.

4. A method of manufacturing a shoe press belt comprising the steps of winding a belt-shaped member having a starting end, a terminal end and parallel side edges, and having the ability by itself to resist both lateral and longitudinal stretching, onto a support body having a cylindrical surface in multiple layers, with the side edges of the belt-shaped member disposed substantially in planar spirals, and forming, from a resin, a Cylindrical, high molecular weight elastic member on the base member so that the elastic member has a wall thickness, so that the base member is embedded within the wall thickness of the elastic member, and so that every point on said starting end is adjacent to a point on said terminal end.

5. A method of manufacturing a shoe press belt in accordance with claim 4, in which the belt-shaped member is wound from a woven fabric impregnated with the same resin from which the elastic member is formed.

6. A method of manufacturing a shoe press belt in accordance with claim 4, in which the belt-shaped member is wound from a woven fabric.

7. A shoe press belt comprising a cylindrical, elastic member formed of a high molecular weight resin and having a base member embedded therein, the cylindrical member having inner and outer walls coaxially disposed about an axis, the inner and outer walls being uniformly spaced from each other radially, whereby the cylindrical member has a uniform thickness, and the base member embedded in the high molecular weight resin being located between the inner and outer walls of the cylindrical member and comprising a belt-shaped member having parallel side edges, the belt-shaped member by itself having the ability to resist both lateral and longitudinal stretching, and being spirally wound in multiple layers, with its side edges disposed substantially in planar spirals, whereby the belt-shaped member of the base has substantially the same width as the belt, the belt-shaped member has a starting end and a terminal end, both said ends being adjacent each other, and both said ends, and the axis of said cylinder, being situated approximately in the same imaginary plane.

8. A shoe press belt according to claim 7, wherein the belt-shaped member comprises a woven fabric impregnated with the same resin as said resin of which the cylindrical, elastic member is formed.

9. A shoe press belt according to claim 7, wherein the belt-shaped member comprises a woven fabric.

10. A method of manufacturing a shoe press belt comprising the steps of winding a belt-shaped member having parallel side edges and the ability by itself to resist both lateral and longitudinal stretching, onto a support body having a cylindrical surface in multiple layers, with the side edges of the belt-shaped member disposed substantially in planar spirals, and forming, from a resin, a cylindrical, high molecular weight elastic member on the base member so that the elastic member has a wall thickness and so that the base member is embedded within the wall thickness of the elastic member, a starting and a terminal end of the belt-shaped member are caused to be situated adjacent each other in the completed shoe press belt, and said starting and terminal end and the axis of said cylindrical surface, are caused to be situated, in the completed shoe press belt, approximately in the same imaginary plane.

11. A method of manufacturing a shoe press belt in accordance with claim 10, in which the belt-shaped member is wound from a woven fabric impregnated with the same resin from which the elastic member is formed.

12. A method of manufacturing a shoe press belt in accordance with claim 10, in which the belt-shaped member is wound from a woven fabric.

* * * * *